US005988062A

United States Patent [19]

Kikuchi

[11] Patent Number: 5,988,062

[45] Date of Patent: Nov. 23, 1999

[54] LIGHT RADIATING DEVICE OF HEATSENSITIVE PERFORATING DEVICE

[75] Inventor: Makoto Kikuchi, Ibaraki-ken, Japan

[73] Assignee: Riso Kagaku Corporation, Tokyo, Japan

[21] Appl. No.: 09/000,837

[22] Filed: Dec. 30, 1997

Related U.S. Application Data

[63] Continuation-in-part of application No. 08/638,047, Apr. 26, 1996, Pat. No. 5,711,218.

[30] Foreign Application Priority Data

Apr. 28, 1995 [JP] Japan ..... 7-105603

[51] Int. Cl.[6] ..... B41C 1/055

[52] U.S. Cl. ..... 101/128.4

[58] Field of Search ..... 101/128.4, 128.21; 362/301

[56] References Cited

FOREIGN PATENT DOCUMENTS 428057 4/1935 United Kingdom ..... 362/301

*Primary Examiner*—Edgar Burr
*Assistant Examiner*—Amanda B. Sandusky
*Attorney, Agent, or Firm*—Kanesaka & Takeuchi

[57] ABSTRACT

A light radiating device of a heatsensitive perforating device includes a casing having an opened lower surface arranged at a perforating plane of a heatsensitive stencil sheet; a light emitting device arranged within the casing, the light emitting means having a bulb portion, a base portion and a contact; an electrode connected to a power supply for energizing the light emitting device, said electrode contacting with the contact of the light emitting device; lower side reflection mirrors contacting with the perforating plane of the heatsensitive stencil sheet; upper side reflection mirrors continuous with the lower side reflection mirrors in a predetermined angle; an upper reflection mirror arranged continuous with the upper side reflection mirrors and in parallel with the perforating plane of the heatsensitive stencil sheet; a holding device for holding the light emitting device in such a manner that a line passing straight through the contact, the center of the base portion and the center of the lower surface of the bulb portion of the light emitting device is perpendicular to the perforating plane of the heatsensitive stencil sheet.

1 Claim, 7 Drawing Sheets

LIGHT RADIATING DEVICE OF HEATSENSITIVE PERFORATING DEVICE

CROSS REFERENCE TO RELATED APPLICATION

This is a continuation in part application of Ser. No. 08/638,047 filed on Apr. 26, 1996, now U.S. Pat. No. 5,711,218.

BACKGROUND OF THE INVENTION

This invention relates to a light radiating device for radiating light against a heatsensitive stencil sheet overlapped on an original image in a heatsensitive perforating device in which an image is perforated in heatsensitive manner on the heatsensitive stencil sheet.

FIG. 6 is a perspective view for showing the prior art heatsensitive perforating device 1 which was proposed by the inventor of the invention. In this figure, a pressing plate 3 is pivotally attached to a base 2. On the upper surface of the base 2 is arranged a base-seat 4 on which an original is mounted. The lower surface of the pressing plate 3 opposing against the base-seat 4 is provided with an opening 6 having a transparent plate 5 therein. At the lower surface side of the transparent plate 5 is removably installed an assembly of the heatsensitive stencil sheet. The assembly of a heatsensitive stencil sheet is made such that the heatsensitive stencil sheet made of a porous supporting member and a heatsensitive film adhered to the supporting member is fixed to one surface of a frame and one side edge of an ink impermeable sheet is adhered to the other side of the frame.

As shown in FIG. 6, a light radiating device 10 is removably installed at the opening 6 of the pressing plate 3. The light radiating device 10 has an virtually quadrate pyramid casing 11. As shown in FIG. 7, a reflection mirror 22 is provided along the inner surface of the casing 11 (21) of the light radiating device 10. The reflection mirror 22 is comprised of lower side reflection mirrors 24 which contact with a perforating plane of the heatsensitive stencil sheet; an upper reflection mirror 23 which is parallel with the perforating plane of the heatsensitive stencil sheet and arranged in the same plane as that of the base of flash bulbs 12; and upper side reflection mirrors 25 which is arranged continuous with the lower side reflection mirrors 24 in a predetermined angle. The upper reflection mirror 23, the lower side reflection mirrors 24 and the upper side reflection mirrors 25 are all plane mirrors.

There is provided on the upper reflection mirror 23 with a hole 23*a* for being inserted by the flash bulbs 12. Plate spring-like electrode 26 is provided between the upper reflection mirror 23 and the casing 11.

An original is placed on the base-seat 4 of the base 2, the heatsensitive stencil sheet assembly is installed on the transparent plate 5 of the pressing plate 3 and then the light radiating device 10 is installed at the opening 6 of the pressing plate 3. As the pressing plate 3 is pressed against the base 2, the heatsensitive stencil sheet of the heatsensitive stencil sheet assembly is closely contacted with the original, so that a switch mechanism not shown in the figure is concurrently closed to cause the light radiating device 10 to be operated. The flash bulbs 12 may generate flash light and this flash light passes through the transparent plate 5 and the heatsensitive stencil sheet to cause an image in the original to be heated. A heatsensitive film of the heatsensitive stencil sheet is formed with perforated images corresponding to the image in the original.

This heatsensitive perforating device 1 is utilized as a printing device after perforating the sheet. That is, the ink impermeable sheet of the assembly is opened, ink is placed on the heatsensitive stencil sheet within the frame and again the ink impermeable sheet is closed. This assembly of the heatsensitive stencil sheet is installed at the pressing plate 3 with the heatsensitive stencil sheet being faced down. If a printing sheet is placed on the base-seat 4 of the base 2 and the pressing plate 3 is pressed against the base 2, the heatsensitive stencil sheet of the assembly is pushed against the printing sheet and then a screen printing is applied to the printing sheet.

In the perforating process performed in the aforesaid heatsensitive perforating device 1 of the prior art, the flash light for thermally perforating the heatsensitive stencil sheet is radiated in a substantial radial direction from the flash bulbs 12.

In the case where thermal perforation is performed with the light radiating device 10 of said heatsensitive perforating device 1, an operator attaches flash bulbs 12 to the light radiating device 10 by hand. Owing to degree of the manual power of the operator, the flash bulbs 12 are sometimes fixed in a leaning position unlike a regular one.

In this state, the bottom of the base portion does not certainly contact with the plate spring-like electrode 26, which sometimes causes perforation failure.

This light radiating device 10 has two flash bulbs 12,12. These two bulbs are positioned symmetrically relative to an imaginary center line of the stencil sheet and they are capable of radiating light equally to the stencil sheet; however, in the case where either one of the bulbs leans, they are not capable of radiating light equally to the stencil sheet, thereby causing perforating failure.

This undesirable phenomenon tends to happen prominently in the case where an image is formed approximately over an entire surface of the perforating plane or in the case that a solid print image is present at the outer circumference of the perforating plane.

SUMMARY OF THE INVENTION

It is an object of the present invention to provide a light radiating device of a heatsensitive perforating device capable of performing a uniform perforation over an entire surface of the perforated plane of the heatsensitive stencil sheet even in the case that an image is formed approximately over an entire surface of the perforating plane or in the case that a solid print image is present at the outer circumference of the perforating plane.

The light radiating device of a heatsensitive perforating device according to a first aspect of the invention is comprised of a casing having an opened lower surface arranged at a perforating plane of a heatsensitive stencil sheet; light emitting means arranged within said casing, said light emitting means having a bulb portion, a base portion and a contact; an electrode connected to a power supply for energizing said light emitting means, said electrode contacting with said contact of said light emitting means; lower side reflection mirrors contacting with the perforating plane of said heatsensitive stencil sheet; upper side reflection mirrors continuous with said lower side reflection mirrors in a predetermined angle; an upper reflection mirror arranged continuous with said upper side reflection mirrors and in parallel with the perforating plane of said heatsensitive stencil sheet; holding means for holding said light emitting means in such a manner that a line passing straight through said contact, the center of said base portion and the center of the lower surface of said bulb portion of said light emitting means is perpendicular to said perforating plane of said heatsensitive stencil sheet.

In the light radiating device of a heatsensitive perforating device according to a second aspect of the invention, the light radiating device is formed according to the first aspect, wherein said holding means is formed in said upper reflection mirror as an annular plate portion having a hole in the center thereof through which said bulb portion of said light emitting means is inserted, said annular plate portion protruding from said upper reflection mirror toward said electrode in a predetermined angle so that said annular plate portion is in areal and circumferential contacts with a curved surface of said bulb portion near said base portion.

In the light radiating device of a heatsensitive perforating device according to a third aspect of the invention, the light radiating device is formed according to the second aspect, wherein said light radiating device further comprises a second holding means which holds said base portion with a screw.

The light radiating device of a heatsensitive perforating device according to a fourth aspect of the invention is comprised of a casing having an opened lower surface arranged at a perforating plane of a heatsensitive stencil sheet; light emitting means arranged within said casing, said light emitting means having a bulb portion, a base portion and a contact; an electrode connected to a power supply for energizing said light emitting means, said electrode contacting with said contact of said light emitting means; a reflection mirror with a continuous reflecting plane integrally comprising lower side reflection mirrors contacting with the perforating plane of said heatsensitive stencil sheet, upper side reflection mirrors continuous with said lower side reflection mirrors in a predetermined angle, and an upper reflection mirror arranged continuous with said upper side reflection mirrors and in parallel with the perforating plane of said heatsensitive stencil sheet; and a supporting means disposed in said casing for locating said reflecting mirror inside said casing.

According to the aforesaid configuration, at least the following actions can be attained. The flash bulbs are installed along the annular plate portion. The annular plate portion contacts with the surfaces of the flash bulbs and supports them. The flush bulbs are not set in a leaning position but directed accurately perpendicularly. The reflection mirror is accurately located within the casing. Therefore, the flash bulbs are capable of radiating light equally to the stencil sheet, thereby performing perforation equally over the entire area of the stencil sheet.

DESCRIPTION OF THE PREFERRED EMBODIMENT

Figure 1:
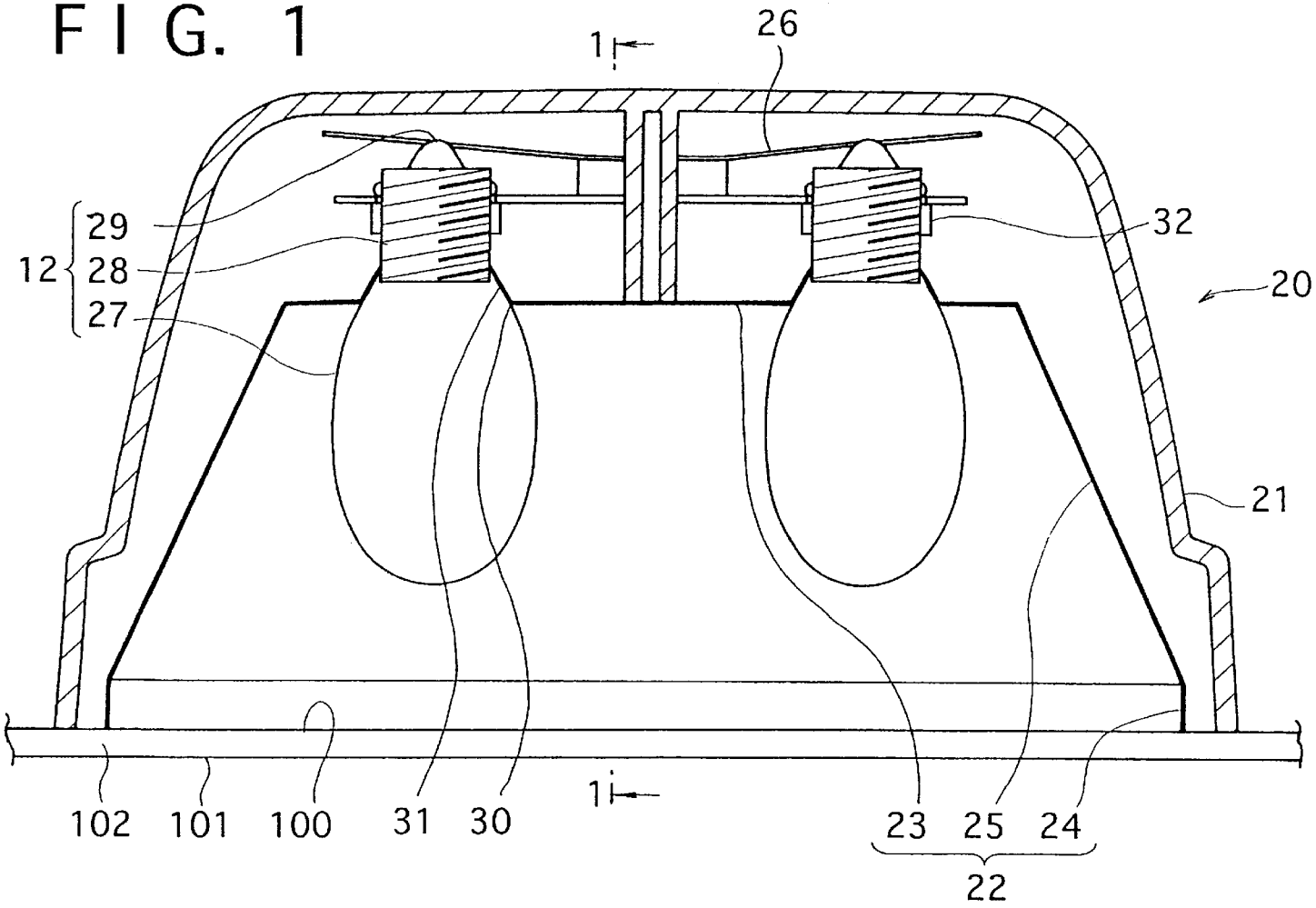
FIG. 1 is a sectional view for showing a first preferred embodiment of the present invention.
Figure 2:
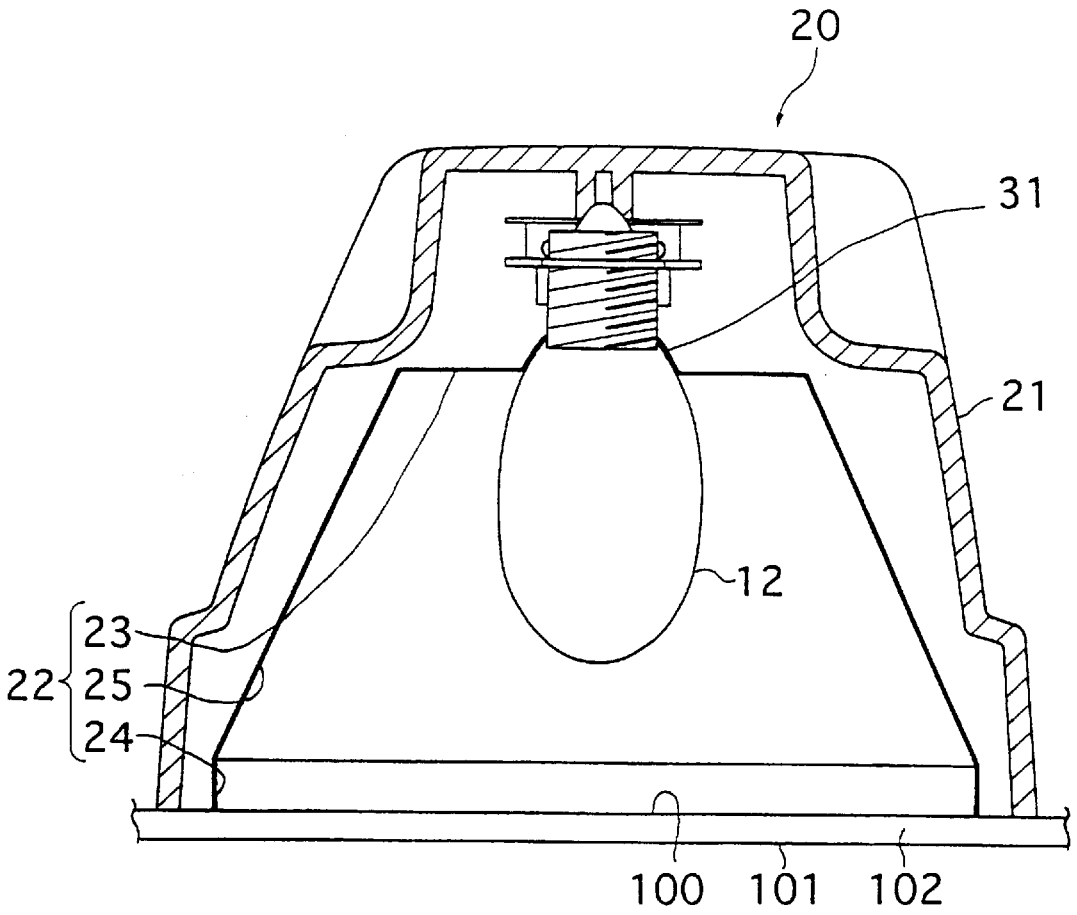
FIG. 2 is a sectional view taken along a line 1—1 of FIG. 1.
Figure 6:
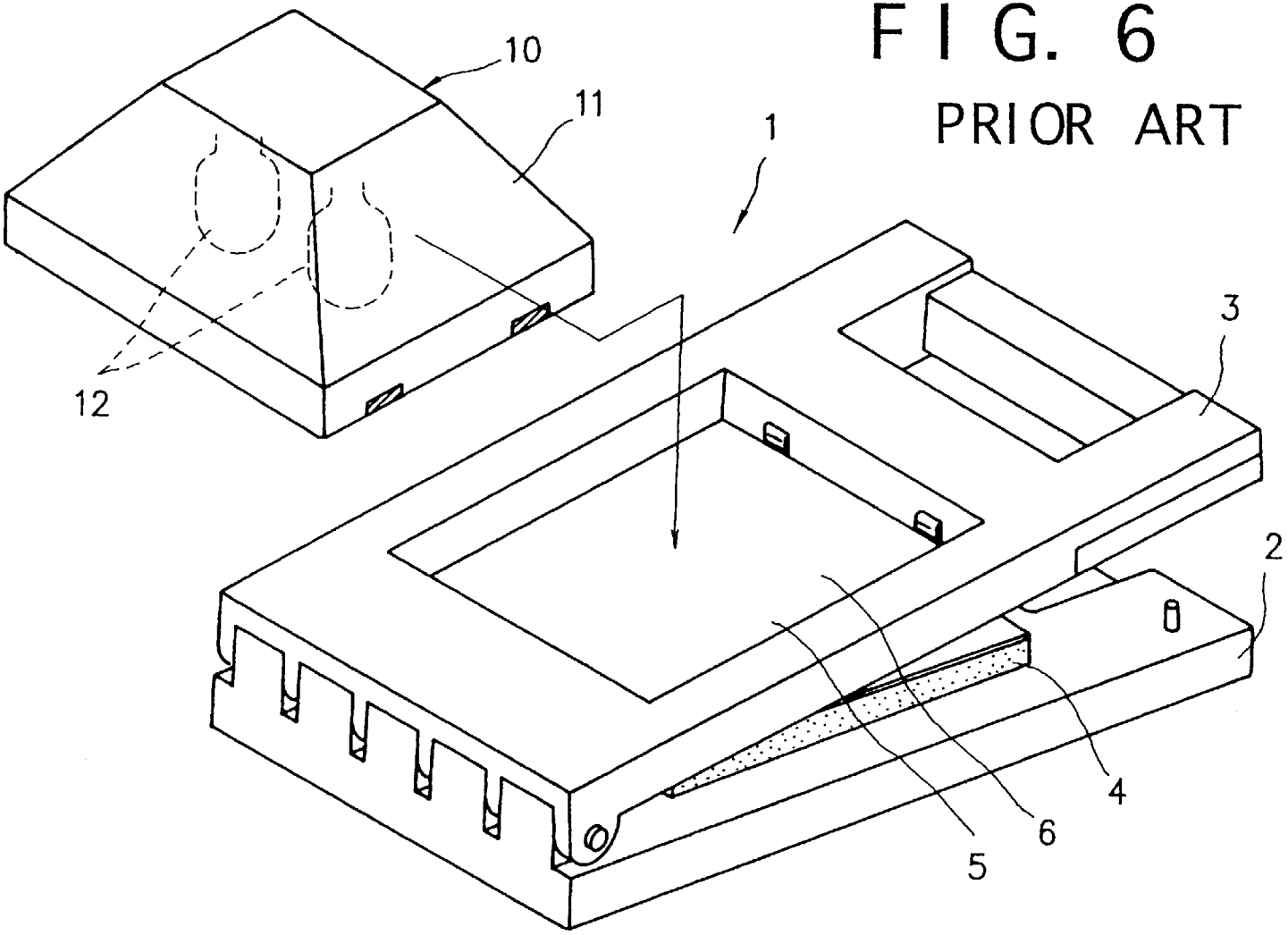
FIG. 6 PRIOR ART
FIG. 6 is a perspective view for showing the prior art light radiating device.
Figure 7:
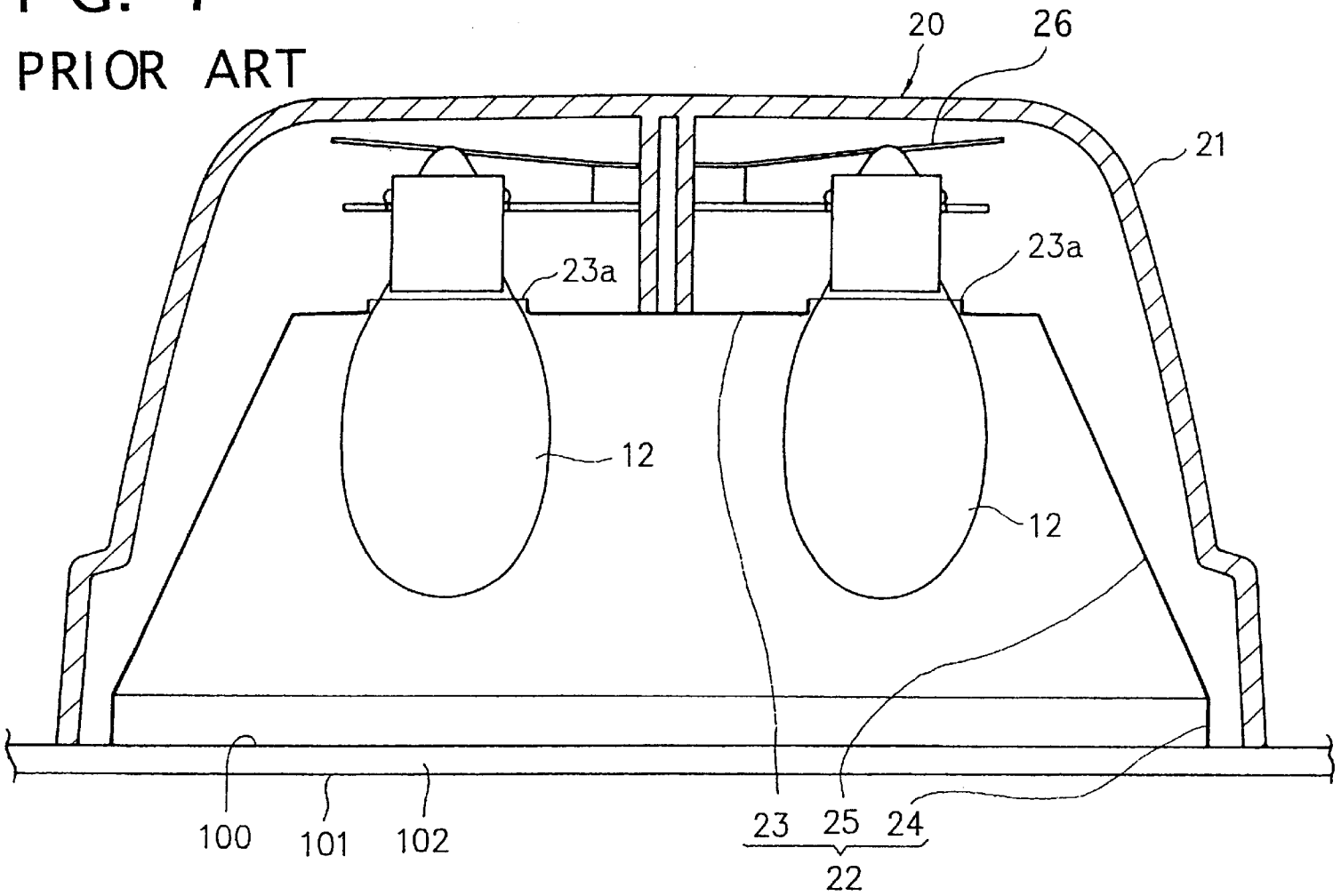
FIG. 7 PRIOR ART
FIG. 7 is a sectional view for showing the prior art light radiating device.

Referring now to FIGS. 1 to 2, a light radiating device 20 of a heatsensitive perforating device of a first preferred embodiment of the present invention will be described. The heatsensitive perforating device to which the present light radiating device 20 is applied is the same as the prior art heatsensitive perforating device 1 described in reference to FIG. 6.

As shown in FIGS. 1 and 2, the light radiating device 20 of the preferred embodiment has a casing 21 of virtually quadrate pyramid. The bottom surface of the casing 21 is opened and this bottom surface is contacted with a transparent plate 102 arranged at a pressing plate of the heatsensitive perforating device. The lower surface of the transparent plate 102 is used as a perforating surface 101 of a heatsensitive stencil sheet under which a heatsensitive stencil sheet is closely contacted. At the inner surface of the casing 21 is arranged a reflection mirror 22 of virtually quadrate pyramid shape. This reflection mirror 22 is also opened at its bottom surface. The reflection mirror 22 is comprised of one upper reflection mirror 23 opposing against and in parallel with a perforating plane of the heatsensitive stencil sheet; lower side reflection mirrors 24 with four side surfaces contacted with the perforating plane of the heatsensitive stencil sheet and raised vertically from the perforating plane; and upper side reflection mirrors 25 with four side surfaces arranged between the lower side reflection mirrors 24 and the upper reflection mirror 23 and kept continuous with the lower side reflection mirrors 24 with side surfaces in a predetermined angle. The lower side reflection mirrors 24 and the upper side reflection mirrors 25 are in a plane form. The lower side reflection mirrors 24, the upper side reflection mirrors 25 and the upper reflection mirror 23 are combined integrally to form a reflection mirror 22 having a continuous reflection surface.

Holes 30 for securing the flash bulbs 12 are formed in the upper reflection mirror 23. Around each of the holes 30, an annular plate portion 31 is formed. The annular plate portion 31 is protruding toward the electrode 26 in a predetermined angle relative to the upper reflection mirror 23. When the flash bulb 12 is attached, the bulb portion 27 is inserted though the hole 30. The annual plate portion 31 is in areal and circumferential contact with a curved surface of the bulb portion 27, supporting the flush bulb 12 stably. Namely, the annular plate portions 31 are holding means for holding the flash bulbs 12. In this state, an imaginary line passing straight through the contact 29, the base portion 28 and the center of the lower surface of the bulb portion 27 of the flush bulb portion 27 is perpendicular to the perforating plane 101 of the heatsensitive stencil sheet.

The reflection mirrors of the present preferred embodiment are made of aluminum.

Flash bulbs 12 acting as light emitting means are detachably attached through the holes 30 formed in the upper reflection mirror 23. Each of the flash bulbs 12 comprises a bulb portion 27, a base portion 28 and a contact 29. Flash bulbs 12 are electrically energized by a power supply (not shown) installed in the heatsensitive perforating device so as to discharge light when predetermined perforating operations by mounting the present light radiating device 20 on the pressing plate 3 of the heatsensitive perforating device and pushing the pressing plate 3 against the base 2 or the like are carried out. As the light emitting means, a radiation bulb or the like may be used.

One example of a practical shape and size in the present light radiating device 20 will be described as follows. The opening 100 at the bottom surface of the reflection mirror 22 is a rectangular shape of 150 mm×102 mm which is adapted for a perforating process for a post card. A spacing between the opening 100 at the bottom surface of the reflection mirror 22 and the upper surface reflection mirror 23 is 59 mm. The opening 100 at the bottom surface of the reflection mirror 22 is contacted with the transparent plate 102 having a thickness of 4 mm arranged at the pressing plate of the heatsensitive perforating device, and the lower surface of the transparent plate 102 is used as the perforating plane 101 of the heatsensitive stencil sheet. Accordingly, a spacing between the perforating plane 101 of the heatsensitive stencil sheet and the upper reflection mirror 23 is 63 mm. The lower side reflection mirrors 24 are vertically raised from the opening 100 at the bottom surface of the reflection mirror 22 and a size of the raised part is 6 mm. A spacing between the lower end of each of the flash bulbs 12 and the opening 100 at the bottom surface of the reflection mirror 22 is 20 mm. Accordingly, a spacing between the lower end of each of the flash bulbs 12 and the perforating plane 101 of the heatsensitive stencil sheet is 24 mm. In the preferred embodiment, the upper ends of the lower side reflection mirrors 24 are placed at positions lower than the lower ends of the flash bulbs 12. An angle between the lower side reflection mirror 24 and the upper side reflection mirror 25 is 155°.

Attaching operation of the flash bulbs 12 will be described concretely.

The base portion 28 of the flash bulb 12 should be inserted to the hole 30. Between the upper reflection mirror 23 and the casing 21, guides 32 acting as holding means for the flash bulbs 12 are provided. The guide 32 is cylindrical. Female thread is formed on the inner peripheral surface of the guide 32. Male thread is formed on the outer peripheral surface of the base portion 28. In the case of screwing the base portion 28 in the guide 32, the contact 29 contacts with the electrode 26 and the base portion 28 is secured in the guide 32 in such position. The annular plate portion 31 is now in areal and circumferential contact with a curved surface of the bulb portion 27, thereby supporting the flash bulb 12 stably.

Figure 3:
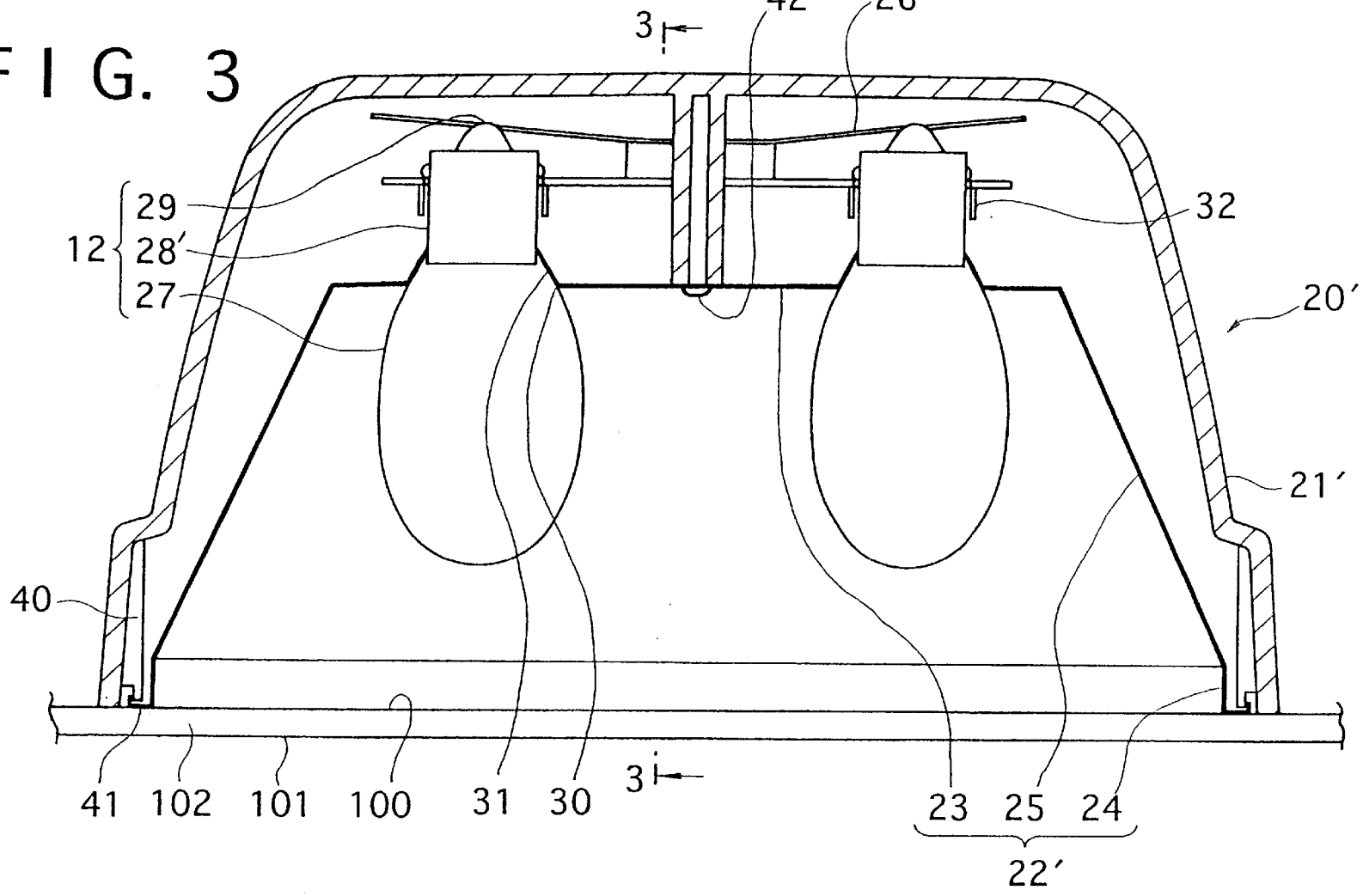
FIG. 3 is a sectional view for showing a second preferred embodiment of the present invention.
Figure 4:
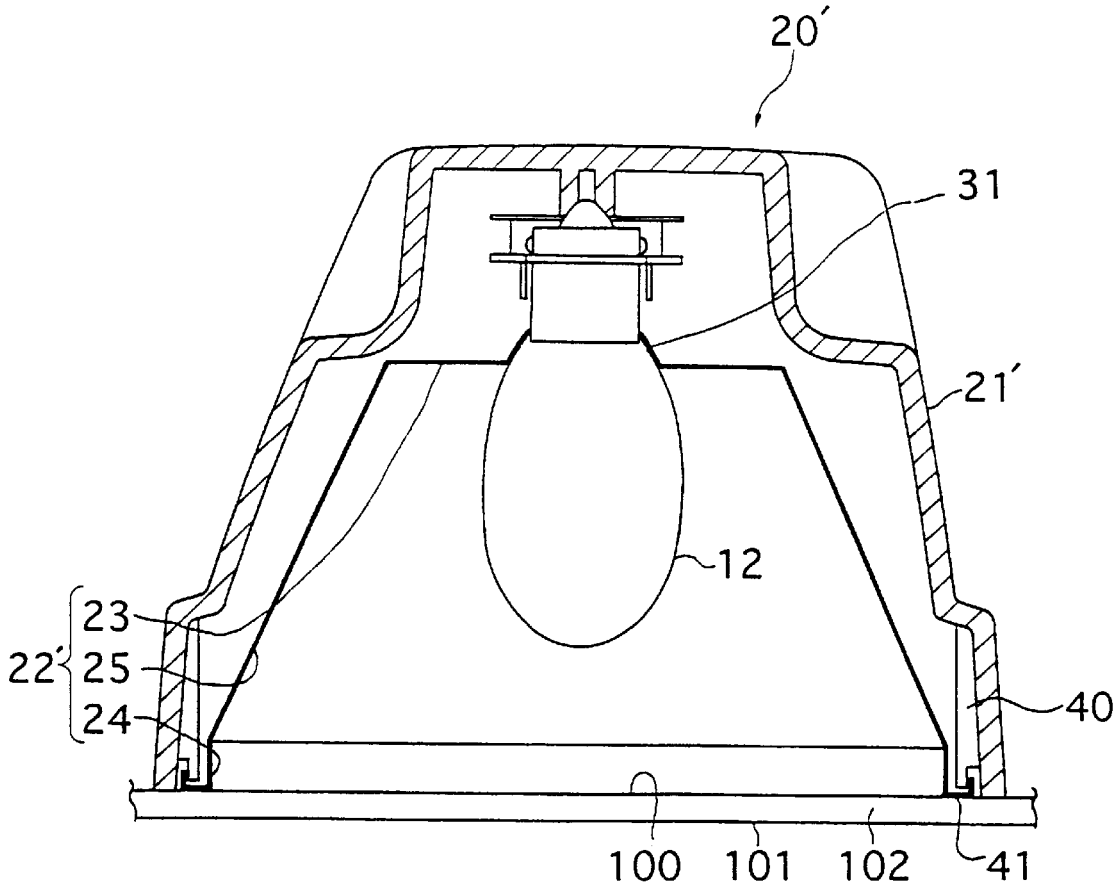
FIG. 4 is a sectional view taken along a line 3—3 of FIG. 3.
Figure 5:
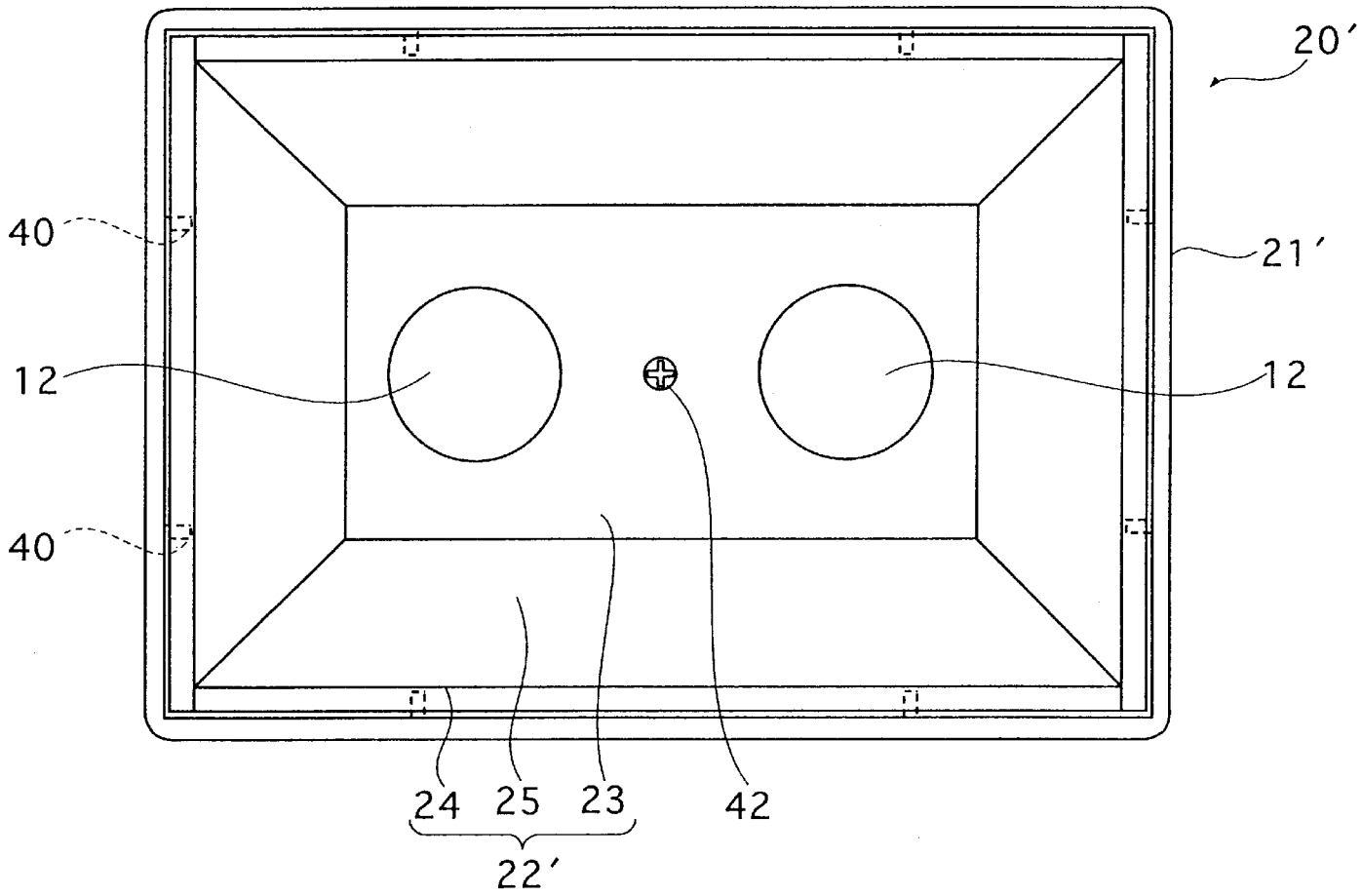
FIG. 5 is a bottom view for showing the second preferred embodiment of the present invention.

Referring to FIGS. 3 to 5, a second preferred embodiment of the present invention will be described. Substantially the same structural parts as the first embodiment are denoted by the same reference numerals as FIGS. 1 and 2, and the description thereof will be omitted for carity.

Plural ribs 40 are provided vertically on the inner surface of the casing 21' of this light radiating device 20' in the vicinity of the opening of the bottom thereof. There are provided respectively two ribs 40 on one plane out of four inner surfaces of the casing 21'. The lower end of the rib 40 does not project outward beyond the opening of the casing 21'. The lower end of the rib 40 is protruding downwardly in a narrower pointing form.

On the lower edge of the lower side reflection mirror 24 of the reflection mirror 22' of the light radiating device 20', engaging means 41 is provided. The engaging means 41 is a portion which is so formed that a plate continuing with the lower side reflection mirror 24 is bent upwardly to show a form of "L" in a sectional view.

In this light radiating device 20', the engaging means 41 engages with the rib 40 of the reflection mirror 22'. The upper reflection mirror 23 of the reflection mirror 22' is fixed to the casing 21' with a screw 42.

In this light radiating device 20', the flash bulb 12 is supported by inserting a base portion 28' with no thread into a guide 32 of a cylindrical shape with no thread, wherein the flush bulbs 12 are supported also by the annular plate portion 31.

In this embodiment, the plural ribs 40 respectively provided on each inner surface of the casing 21' stably support the engaging means 41 when the reflection mirror 22' is assembled into the casing 21'. Consequently the reflection mirror 22' is accurately positioned to the casing 21' just by fixing the upper reflection mirror 23 of the reflection mirror 22' to the casing 21' with a screw 42. Therefore, flash light is radiated from the flush bulbs 12 in a regular condition, covering equally the entire area of the perforating plane.

According to the light radiating device of the heatsensitive perforating device in this invention, the glass bulb portion of the flash bulb is supported by the annular plate portion formed around the hole through which the flash bulb is inserted. Consequently the flash bulb is attached to the predetermined position in a regular manner without leaning. Further, the reflection mirror is positioned accurately to the casing by the rib of the casing and the engaging means of the reflection mirror. Therefore, flash light is radiated from the flash bulbs in a regular condition, covering equally the entire area of the perforating plane.

What is claimed is:

1. A light radiating device for a heatsensitive perforating device comprising:

a casing having an opened lower surface arranged at a perforating plane of a heatsensitive stencil sheet;

light emitting means arranged within said casing, said light emitting means having a bulb portion, a base portion adjacent the bulb portion and a contact;

an electrode connected to a power supply for energizing said light emitting means, said electrode contacting with said contact of said light emitting means;

a reflection mirror with a continuous reflecting plane integrally formed together and comprising lower side reflection mirrors contacting with the perforating plane of said heatsensitive stencil sheet; upper side reflection mirrors continuous with said lower side reflection mirrors arranged in a predetermined angle with respect to the lower side reflection mirrors; an upper reflection mirror arranged continuous with said upper side reflection mirrors and in parallel with the perforating plane of said heatsensitive stencil sheet; and engaging means extending laterally outwardly from the lower side reflection mirrors; and supporting means disposed in said casing for fixing a center portion of the upper reflection mirror and locating said reflecting mirror inside said casing by engaging the lower side reflection mirror, said supporting means including near the lower surface a plurality of ribs with lower ends protruding downwardly in narrow pointing forms, said engaging means engaging the lower ends of the ribs.

* * * * *